US010992095B2

(12) United States Patent
Funke et al.

(10) Patent No.: US 10,992,095 B2
(45) Date of Patent: Apr. 27, 2021

(54) DEVICE FOR MANUFACTURING AN ELECTRICAL PLUG-IN CONNECTOR

(71) Applicant: Phoenix Contact GmbH & Co. KG, Blomberg (DE)

(72) Inventors: Christian Funke, Detmold (DE); Frank Best, Bueckeburg (DE)

(73) Assignee: PHOENIX CONTACT GMBH & CO. KG, Blomberg (DE)

( * ) Notice: Subject to any disclaimer, the term of this patent is extended or adjusted under 35 U.S.C. 154(b) by 304 days.

(21) Appl. No.: 16/106,015

(22) Filed: Aug. 21, 2018

(65) Prior Publication Data

US 2019/0067893 A1 Feb. 28, 2019

(30) Foreign Application Priority Data

Aug. 21, 2017 (BE) ..... 2017/5574

(51) Int. Cl.
*H01R 43/16* (2006.01)
*H01R 13/11* (2006.01)
(Continued)

(52) U.S. Cl.
CPC ..... *H01R 43/16* (2013.01); *H01R 13/11* (2013.01); *H01R 13/41* (2013.01); *H01R 43/20* (2013.01);
(Continued)

(58) Field of Classification Search
CPC .... H01B 13/00; H01B 13/012; H01R 12/724; H01R 12/727; H01R 13/11; H01R 13/40;
(Continued)

(56) References Cited

U.S. PATENT DOCUMENTS 5,157,827 A 10/1992 Olsson
5,667,392 A 9/1997 Kocher et al.
(Continued)

FOREIGN PATENT DOCUMENTS

CN 104882704 A 9/2015
CN 206364206 U 7/2017
(Continued)

*Primary Examiner* — Carl J Arbes
(74) *Attorney, Agent, or Firm* — Leydig, Voit & Mayer, Ltd.

(57) ABSTRACT

A method for manufacturing an electrical plug-in connector, an electrical connector element, which has a first contacting portion for plug-in connection to a contact of a first contact carrier and a second contacting portion, angled with respect thereto, for connection with a contact of a second contact carrier, being introduced into a receiving chamber of a housing body, vis-à-vis a device having a housing body receptacle and a connector element receptacle, includes the following steps: a1) placing the housing body receptacle and the connector element receptacle in a receiving position for equipping them with the electrical connector element; b1) arranging the electrical connector element at the connector element receptacle; c1) arranging the housing body at the housing body receptacle; d1) moving the housing body receptacle and the connector element receptacle toward one another using a drive element such that a joining movement is produced.

17 Claims, 8 Drawing Sheets

(51) Int. Cl.

| | |
|---|---|
| ***H01R 43/26*** | (2006.01) |
| ***H01R 43/20*** | (2006.01) |
| ***H01R 13/41*** | (2006.01) |
| *H01R 12/72* | (2011.01) |

(52) U.S. Cl.
CPC ..... *H01R 43/26* (2013.01); *H01R 12/724* (2013.01); *H01R 12/727* (2013.01)

(58) Field of Classification Search
CPC ..... H01R 13/41; H01R 13/436; H01R 13/52; H01R 13/5208; H01R 43/16; H01R 43/18; H01R 43/20; H01R 43/26
See application file for complete search history.

(56) References Cited

U.S. PATENT DOCUMENTS

| | | | |
|---|---|---|---|
| 2004/0235321 | A1 | 11/2004 | Mizumura et al. |
| 2008/0102712 | A1 | 5/2008 | Giefers |
| 2008/0256792 | A1 | 10/2008 | Imai et al. |

FOREIGN PATENT DOCUMENTS

| | | | | |
|---|---|---|---|---|
| DE | 202006016424 | U1 | | 1/2007 |
| EP | 1933428 | A2 | | 6/2008 |
| JP | 61-294711 | A | * | 12/1986 |
| JP | 2012234845 | A | | 11/2012 |

* cited by examiner

DEVICE FOR MANUFACTURING AN ELECTRICAL PLUG-IN CONNECTOR

CROSS-REFERENCE TO PRIOR APPLICATION

Priority is claimed to Belgian Patent Application No. BE 2017/5574, filed on Aug. 21, 2017, the entire disclosure of which is hereby incorporated by reference herein.

FIELD

The invention relates to a method for manufacturing an electrical plug-in connector and to a device for manufacturing an electrical plug-in connector.

BACKGROUND

Electrical plug-in connectors are generally known and serve to establish an electrical connection between contacts of contact partners via electrical connector elements. Plug-in connectors of the relevant type have the property that a contact carrier can be plugged in on at least one face of the plug-in connector and, as a result of the plugging-in, electrical contact with the electrical connector element can be implemented. Electrical plug-in connectors of this type are known for example from DE 20 2006 016424 U1.

For manufacturing a plug-in connector, various methods and devices are known by means of which electrical connector elements are introduced into a receiving chamber of a housing body, an electrical connector element having a first contacting portion for a plug-in connection to a contact of a first contact carrier and having a second contacting portion, angled with respect thereto, for connection to a contact of a second contact carrier.

Accordingly, a plug-in connector of this type has two contact faces which are angled with respect to one another, it being possible to arrange a contact carrier on each contact face so as electrically to interconnect the associated contacts thereof via the plug-in connector.

Methods of the relevant type for manufacturing an electrical plug-in connector provide that an electrical connector element is introduced, by means of a device having a housing body receptacle and a connector element receptacle, into a receiving chamber of a housing body by way of a sequence of different method steps.

The housing body receptacle and connector element receptacle are displaced into a receiving position for equipping them with the electrical connector element, whereupon the electrical connector element is arranged at the connector element receptacle, and the housing body provided for receiving the electrical connector element is arranged at the housing body receptacle. The housing body receptacle and the connector element receptacle are movable relative to one another between a receiving position, in which the housing body receptacle and the connector element receptacle are spaced apart from one another in order to arrange the housing body/bodies at the housing body receptacle and the one or more electrical connector elements at the connector element receptacle, and a joining position, in which the housing body receptacle and the connector element receptacle are brought close together and the one or more electrical connector elements are introduced into the receiving chamber of the housing body.

Further, in the context of the, a removal state is characterized in that the housing body/bodies along with the electrical connector elements arranged therein are removable from the device, in particular by the housing receptacle and the connector element receptacle being spaced apart from one another.

Thereupon, in a further step, the housing body receptacle and the connector element receptacle are moved towards one another by a drive element in such a way that a joining movement is produced, by means of which the electrical connector element is introduced at least in portions into the receiving chamber of the housing body of the housing in a joining direction.

Once the electrical connector element is introduced into the receiving chamber of the housing body, the housing body receptacle and connector element receptacle are displaced into a removal state, in which the housing body, along with the connector element introduced into the receiving chamber, can be removed from the device.

For manufacturing plug-in connectors, devices of the relevant type are also known which have a joining apparatus, which in turn has a housing body receptacle for receiving a housing body, a connector element receptacle for receiving an electrical connector element, which has a first contacting portion for plug-in connection to the contact of a first contact carrier and a second contacting portion, angled with respect thereto, for connection to a contact of a second contact carrier, and a drive element for producing a joining movement between the housing body receptacle and the connector element receptacle. Further, equipping devices of the relevant type are equipped with a drive apparatus, which serves to produce a joining movement between the housing body receptacle and the connector element receptacle so as to introduce the electrical connector element at least in portions into a receiving chamber of the housing body in a joining direction.

SUMMARY

In an embodiment, the present invention provides, a method for manufacturing an electrical plug-in connector, an electrical connector element, which has a first contacting portion for plug-in connection to a contact of a first contact carrier and a second contacting portion, angled with respect thereto, for connection with a contact of a second contact carrier, being introduced into a receiving chamber of a housing body, vis-à-vis a device having a housing body receptacle and a connector element receptacle, the method comprising the following steps: a1) placing the housing body receptacle and the connector element receptacle in a receiving position for equipping them with the electrical connector element; b1) arranging the electrical connector element at the connector element receptacle; c1) arranging the housing body at the housing body receptacle; d1) moving the housing body receptacle and the connector element receptacle toward one another using a drive element such that a joining movement is produced, by which the electrical connector element is introduced at least in portions into the receiving chamber of the housing body of the housing in a joining direction; e1) spacing the housing body receptacle and the connector element receptacle apart from one another such that the housing body, along with the connector element introduced at least in portions into the receiving chamber, is removable from the device, wherein b2) a plurality of electrical connector elements are arranged at the connector element receptacle for joint introduction into the receiving chamber of a housing body, such that, for the introduction, at least two electrical connector elements of the plurality of connector elements are arranged so as to be mutually offset in the joining direction at the connector element receptacle, and c2) the plurality of electrical connector elements are jointly introduced at least in portions into the receiving chamber of the housing body by way of the joining movement between the housing body receptacle and the connector element receptacle.

BRIEF DESCRIPTION OF THE DRAWINGS

The present invention will be described in even greater detail below based on the exemplary figures. The invention is not limited to the exemplary embodiments. Other features and advantages of various embodiments of the present invention will become apparent by reading the following detailed description with reference to the attached drawings which illustrate the following.

DETAILED DESCRIPTION

Figure 1:
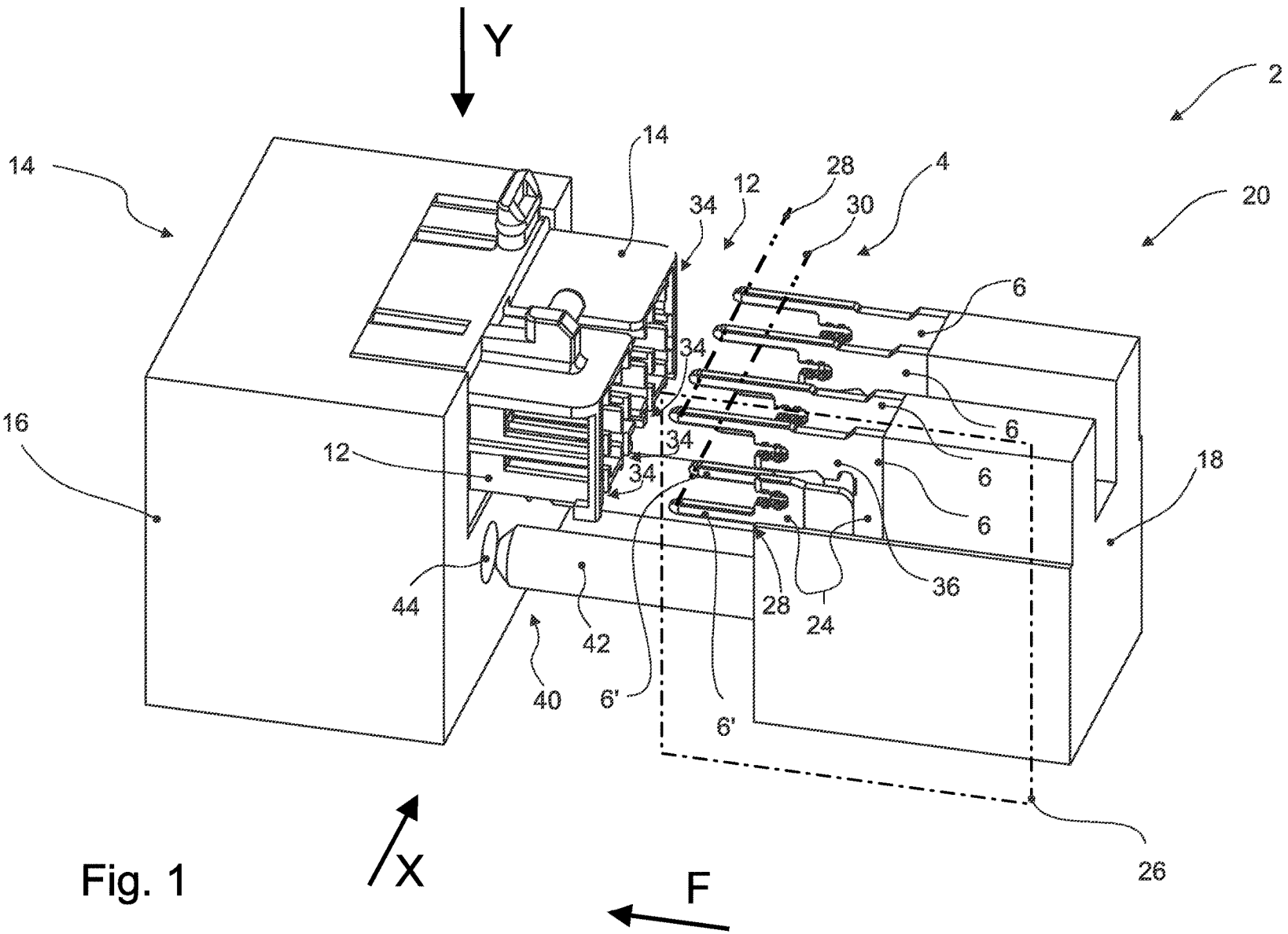
FIG. 1 is a schematic perspective view of the embodiment of a device according to the invention in a receiving position, the housing body and the electrical connector element already having been arranged, said device being equipped with a housing body and electrical connector elements for carrying out a method according to the invention.

In an embodiment, the present invention provides a method and a device for manufacturing an electrical plug-in connector which make possible reliable and simple introduction of electrical connector elements into a receiving chamber of a housing body of a plug-in connector.

The invention moves away from the idea of configuring the housing body in a modular manner, so as to make it possible to simplify the manufacture of a plug-in connector and carry it out cost-effectively.

The invention further moves away from the idea of increasing the number of steps for the joining process.

Rather the invention is based on the underlying idea of introducing the individual electrical connector elements jointly into the receiving chamber of the housing body of a plug-in connector.

For this purpose, a method according to the invention provides that a plurality of electrical connector elements are arranged at the connector element receptacle for joint introduction into the receiving chamber of a housing body. They are arranged in such a way that, for the introduction, at least two electrical connector elements of the plurality of connector elements are arranged so as to be mutually offset in the joining direction at the connector element receptacle.

In addition, a method according to the invention further provides that the plurality of electrical connector elements are jointly introduced at least in portions into the receiving chamber of the housing body by way of the joining movement between the housing body receptacle and the connector element receptacle.

The invention also provides a device for manufacturing an electrical plug-in connector, which is characterized in that the joining apparatus is set up and formed for jointly introducing a plurality of electrical connector elements, received at the connector element receptacle, at least in portions into the receiving chamber of the housing body. In this context, the invention provides that, for the introduction, at least two electrical connector elements of the plurality of connector elements are so as to be arranged mutually offset in the joining direction at the connector element receptacle.

In the context of the invention, a housing body is manufactured at least in portions from or comprises an electrically insulating material, in particular a plastics material. Further, an electrical connector element is manufactured from an electrically conductive material, in particular from metal, preferably from copper or a copper alloy. For this purpose, it may be manufactured for example and in particular from a sheet metal or a plate manufactured from a corresponding material.

The invention leads to the advantage that, in an arrangement in which the electrical connector elements are arranged spaced apart or offset with respect to one another in the joining direction, it is possible to dispense with subsequent introduction of the electrical plug-in connector.

Therefore, in the context of the invention, it is not necessary to first introduce a series of electrical connector elements and subsequently in a further step to introduce a further series of electrical connector elements, which is to be arranged so as to be offset therefrom in the joining direction in the housing body, together with electrical connector elements in the receiving chamber of the housing body.

Thus, according to the invention the aforementioned two joining processes may be reduced to one, and this also reduces the costs of manufacturing an electrical plug-in connector.

The invention thus leads to the advantage that the joining process is simplified in that the electrical connector elements are introduced into the housing body jointly within one joining process.

First, the invention brings about savings on time and costs. Further, the invention makes it easier to equip an equipping device according to the invention, handle it for the joining processes, and carry out the joining by a method according to the invention. The invention thus also leads to the advantage of process reliability and operating reliability since the electrical connector elements can be introduced into the receiving chamber of an electrical plug-in connector in a concentrated manner in one step.

The invention thus makes it possible to manufacture in a simple manner an electrical plug-in connector in which the electrical connection apparatuses are introduced in a row-and-column arrangement.

For this purpose, it is initially provided, in an advantageous development of a method according to the invention, that at least one first connector element and at least one second connector element are introduced into the receiving chamber in such a way that they are arranged in a shared joining plane in the receiving chamber in the joining state.

In an advantageous development, a device according to the invention is accordingly advantageously configured in such a way that the connector element receptacle is set up and formed in such a way that the first and the second connector element are arranged in a shared joining plane in the receiving chamber when in the joining state.

This results in the advantage that the equipping of a housing body with electrical connector elements is improved, since more electrical connector elements can be introduced into a housing body. Accordingly, these can be arranged alongside one another at only a small spacing so as to preserve electrical separation from one another.

The invention thus makes possible an arrangement in which the first and the second connector element overlap at least in portions in the joining direction.

For this purpose, an advantageous development according to the invention of the method provides that the at least two electrical connector elements of the plurality of electrical connector elements are introduced into the receiving chamber in such a way that, in the joining state, they are arranged in the receiving chamber in a shared plane spanned by the first contacting portion and second contacting portion of at least one of the at least two electrical connector elements.

Accordingly, in the context of the invention, it is also taken into account that, for introduction into the receiving chamber of the housing body, the at least two electrical connector elements are arranged at the connector element receptacle in a shared plane spanned by the first contacting portion and second contacting portion of at least one of the at least two electrical connector elements.

Thus, in an advantageous development of the device according to the invention, the invention provides that the at least two electrical connector elements are arranged at the connector element receptacle in a shared plane spanned by the first contacting portion and second contacting portion of at least one of the at least two electrical connector elements.

This results in the advantage that the space requirement for a plug-in connector manufactured according to the invention can be kept low, resulting in further advantages for a plug-in connector manufactured according to the invention.

To further simplify the arrangement of the electrical connector elements in the receiving chamber of the housing body, in a further advantageous development of the invention relating to the method, it is provided that at least two electrical connector elements of the plurality of electrical connector elements are introduced into the receiving chamber in such a way that, in the joining state, they are arranged in the receiving chamber in a shared plane spanned by the first contacting portion and second contacting portion of at least one of the at least two electrical connector elements.

In the context of the invention, the joining state is characterized in that the electrical connector element is introduced into the receiving chamber of the housing body.

In this context, according to the invention, it is taken into account that the first contacting portions and/or the second contacting portions of the plurality of electrical connector elements are in each case arranged at a spacing from one another at the connector element receptacle in a plurality of rows as a grid, preferably in the manner of a matrix.

The electrical connector elements may therefore be arranged at the connector element receptacle and, after the joining process, also at the housing body in a row-and-column arrangement, as described above.

Accordingly, in a corresponding advantageous development of the invention relating to the device, it is provided that the first contacting portions and/or the second contacting portions of the plurality of electrical connector elements are in each case arranged at a spacing from one another at the connector element receptacle in a plurality of rows as a grid, preferably in the manner of a matrix.

Thus, according to the invention, the electrical connector elements can be arranged in various configurations. For example, they can be arranged in a plurality of rows so as to create a plug face of the plug-in connector. In the context of the invention, electrical connector elements in one row are preferably upstream in the joining direction from a row comprising further electrical connector elements.

According to the invention, the plug-in connectors also need not be arranged at a uniform spacing with respect to one another within a row or in the joining direction. Preferably, for simplified handling during manufacture, they are in particular arranged in such a way that they are at the same distance in the joining direction and are arranged in this manner at the connector element receptacle or in the receiving chamber of the housing body.

To achieve as low a construction size as possible of the plug-in connector, an advantageous development relating to a method according to the invention likewise includes the plurality of electrical connector elements being introduced into the receiving chamber of the housing body by way of the joining movement via a lateral, in particular slot-shaped, opening in the housing body.

In the context of the invention, it is possible for the drive element to produce a joining movement between the housing body receptacle and the connector element receptacle merely to move one of the aforementioned receptacles, whilst the remaining receptacle remains stationary, or for both receptacles to be moved. The nature of the drive movement for producing a joining movement between the housing body receptacle and the connector element receptacle may therefore be chosen freely.

Accordingly, it is likewise provided, in a corresponding advantageous development of a device according to the invention, that the drive element moves the housing body receptacle and the connector element receptacle toward one another during the joining movement in such a way that the joining movement introduces at least one electrical connector element of the plurality of electrical connector elements into the receiving chamber of the housing body via a lateral, in particular slot-shaped, opening in the housing body.

In the context of the invention, a lateral opening in the housing body is parallel to the plane spanned by the first contacting portion and second contacting portion of an electrical connector element.

When electrical connector elements are lined up, the lateral opening is arranged on the housing body transversely to the line-up direction in which the electrical connector elements are lined up along the relevant row.

For simplification, a further advantageous development of a method according to the invention provides that the plurality of electrical connector elements are introduced into the housing body by way of a translational, in particular linear, movement between the housing body receptacle and the connector element receptacle.

The advantage of a simple application of the method is taken into account in a correspondingly advantageous development relating to the device according to the invention, in which the drive element is set up and formed in such a way that they bring about a translational, in particular linear, joining movement between the housing body receptacle and the connector element receptacle.

Accordingly, a movement sequence which is simple in accordance with the invention during the joining movement enables simple and cost-effective implementation of a method according to the invention and accordingly enables a simple construction of a device according to the invention.

To ensure reliable connection, the electrical connector element is to be held accordingly on the housing body. To achieve this, a further advantageous development of a method according to the invention provides that at least one of the electrical connector elements is plugged, by means of a clamping slot formed thereon, onto a housing rib of the housing body, so as to hold the connector element on the housing body in the joining state. This is taken into account in that, by way of the joining movement between the housing body receptacle and the connector element receptacle, at least one electrical connector element is joined in such a way that a clamping slot in the electrical connector element is slid at least in portions onto a housing rib of the housing body.

By means of the clamping slot, sufficiently large clamping or holding forces to be able to attach the electrical connector element rigidly and thus securely to the housing body can be achieved in a simple manner. Accordingly, the development comprises the electrical connector elements together having a clamping slot formed therein as well as the provision of a housing body comprising a housing rib for the clamping slot.

Accordingly, an advantageous development linked thereto relating to a device according to the invention is based on the drive element producing a joining movement between the housing body receptacle and the connector element receptacle in such a way that in the joining state, in which the electrical connector element is introduced at least in portions into the receiving chamber of the housing body, a clamping slot formed in the electrical connection element is at least in portions mounted in a clamping manner onto a housing rib of the housing body so as to hold the connector element on the housing body.

The contacting of the relevant contacting portions by contacts of the contact carriers should be configured in such a way that handling is as simple and reliable as possible.

In accordance with this inventive idea, a further advantageous development of a method according to the invention is characterized in that, by way of the joining movement between the housing body receptacle and the connector element receptacle, at least one electrical connector element is joined in such a way that a contacting portion of the electrical connector element exits the receiving chamber through an exit opening at least one contacting face, preferably two contacting faces, of the housing body.

According to the invention, a contacting face of a housing body is one at which there is contacting with the relevant contact carrier in such a way that the associated contacts thereof can be electrically connected to the corresponding contact portions of the relevant electrical connector element.

This context also includes a device according to the invention being set up and formed in such a way that the joining movement between the housing body receptacle and the connector element receptacle joins at least one electrical connector element in such a way that, in the joining state, the electrical connector element has, at least one contacting face, preferably two contacting faces, of the housing body, the connector element receptacle for receiving at least one electrical connector element comprising a plate-shaped connecting portion, via which the first and second contacting portions of said elements are interconnected.

Accordingly, the accessibility of the contacting portions for electrical contacting with a contact of a contact carrier is improved.

In the context of the invention, one exit opening per contacting portion or per electrical connector element as well as one exit opening for a plurality of or all of the electrical connectors or the respective first or second contacting portion thereof may be provided.

In the context of the invention, the electrical connector elements are individual components which are introduced as such into the receiving chamber of the housing body so as to enable electrical conduction from the first contacting portion to the second contacting portion.

The first contacting portion is used for a plug-in connection to a contact carrier, which may be a mating plug. The second contacting portion may accordingly also be designed for a plug-in connection. For this purpose, the contact portions may for example and in particular each be configured as a contact pin or contact socket. It is likewise possible for them to be formed differently. Thus, for example and in particular, the second contacting portion may be set up and formed for contacting contacts or printed conductors of a circuit board.

In this regard, a method according to the invention or a device according to the invention may be used for establishing plug-in connector terminals for circuit boards.

In this connection, in a further advantageous development relating to a method according to the invention, it is provided that the connector element receptacle is set up and formed for receiving electrical connector elements, of which at least one electrical connector element has a contact portion formed as a contact pin or contact socket.

Accordingly, in a corresponding advantageous development relating to a device according to the invention, it is provided that the connector element receptacle is set up and formed for receiving a plurality of electrical connector elements, of which at least one electrical connector element has a first contacting portion and/or second contacting portion formed as a contact pin or contact socket.

To establish the center of gravity of a plug-in connector in a simple manner, in a further advantageous development of a method according to the invention it is provided that the connector element receptacle is set up for receiving a plurality of electrical connector elements, of which at least one electrical connector element has a plate-shaped connecting portion via which the contacting portions of said elements are interconnected.

This further advantageously results in it being possible to establish the center of gravity of the relevant electrical connector element in the joining state. Therefore, adaptation of the configuration of the housing body in terms of the center of gravity of the plug-in connector can be omitted according to the invention. Further, the joining can be promoted by the use of a correspondingly rigid electrical connector element.

For this purpose, in a corresponding advantageous development relating to a device according to the invention, it is provided that the connector element receptacle for receiving at least one electrical connector element comprising a plate-shaped connecting portion, via which the first and second contacting portions of said elements are interconnected.

For reliable and simple introduction of the electrical connector element into the receiving chamber of the housing body, an advantageous development of a method according to the invention provides that the connector elements are arranged at the connector element receptacle in such a way that the first or second contacting portion of at least one electrical connector element protrudes beyond an outer edge of the connector element receptacle at which the connector element is arranged.

Taking this into account, an advantageous development linked thereto of a device according to the invention provides that the connector element receptacle is set up and formed in such a way that at least one contacting portion of an electrical connector element protrudes in the joining direction beyond an outer edge of the connector element receptacle at which the connector element is arranged.

As a result of the arrangement, it is simple to adjust or specify the introduction depth by which the electrical connector element is introduced into the receiving chamber of the housing body.

The introduction of an electrical connector element into the receiving chamber of a can be simplified by the joining movement being directed in parallel with a plug-in connection axis of the plug-in connector, along which axis a plug-in movement between the plug-in connector and a contact carrier formed as a mating plug results in said connector and carrier being electrically connected, as specified by an advantageous development of a device according to the invention.

A corresponding advantageous development of a method according to the invention is therefore based on the drive element producing a joining movement in parallel with a plug-in connection axis of the plug-in connector, along which axis a plug-in movement between the plug-in connector and a contact carrier formed as a mating plug said connector and carrier being electrically connected.

For improved guidance of the movement, an advantageous development of a device according to the invention initially provides that the joining apparatus has a guide device for at least at times guiding the movement of the housing body receptacle and the connector element receptacle toward one another during the joining movement. This makes sufficiently precise guidance of the housing body receptacle and connector element receptacle possible.

In addition, in an advantageous development linked thereto of a device according to the invention it is provided that the joining apparatus has a guide device comprising at least a first guide element and a second guide element corresponding thereto, which cooperate so as to at least at times guide the movement of the housing body receptacle and the connector element receptacle toward one another during the joining movement.

For this purpose, a first guide element may be provided on the connector element receptacle and the second guide element may be provided on the housing body receptacle, and they may cooperate accordingly during the joining movement to guide the connector element receptacle and the housing body receptacle.

For simple implementation, in a further advantageous development of a device according to the invention it is determined that the first guide element is a guide journal and the corresponding guide element is a guide socket into which the guide journal dips at least in portions to guide the movement.

The guide journal and the guide socket are tuned to one another for guiding the movement, this guidance being simple and cost-effective to implement.

The features described above and below relating to a device according to the invention and a method according to the invention complement one another, and are thus transferrable between a device according to the invention and a method according to the invention. Thus, the features also apply comprehensively and in isolation from one another or separately from the described configuration and dependency on other elements, constituents, features or other requirements.

Hereinafter, the invention is described in greater detail by way of the accompanying drawings, in which, as representative for a plurality of devices according to the invention, an embodiment of a device according to the invention for manufacturing an electrical plug-in connector is shown, and on the basis of which a method according to the invention is also illustrated.

In this context, all features claimed, described and shown in the drawings, in their own right or in any desired combination, form the subject matter of the invention, irrespective of how they are combined in the claims and the dependencies thereof and irrespective of their description or illustration in the drawings.

The drawings show a possible embodiment of a device according to the invention, in each case schematically.

The illustrations in the drawings are therefore in particular not to scale, and so the relative measurements selected in each of the drawings may also be or are also different. For improved clarity, the drawings are reduced to the elements/components/constituents which assist in comprehension. In the drawings, like or corresponding components/constituents or elements are provided with like reference numerals.

For improved clarity, not all elements/components/constituents are always provided with reference numerals in the drawings, resulting in assignment by way of the same illustration or an illustration adapted to the view.

Hereinafter, for improved clarity, in the event of an identical or similar construction the description is reduced to the differences between the embodiments or drawings.

In this context, the details mentioned in relation to the features of the embodiments shown in the drawings also complement one another, and so the relevant details also apply transferably, in an equivalent or analogous manner, to the various embodiments and to further devices or methods according to the invention formed according to the invention. The invention is therefore not limited to the described and shown embodiments.

Hereinafter the embodiment of a modular device according to the invention is also referred to using the term "device" for short. Further, an electrical connector element is referred to as a connector element for short.

FIG. 1 shows the embodiment of a device 2 according to the invention for producing an electrical plug-in connector 4 (shown in FIG. 8 after the joining method is ended), which device serves to introduce an electrical connector element 6, which has a first contacting portion 8 (shown in FIG. 4 and uniformly denoted by reference numeral 8) for plug-in connection to a contact of a first contact carrier and a second contacting portion 10, angled with respect thereto, for connection to a contact of a second contact carrier, into a receiving chamber 12 of a housing body 14 by means of a housing body receptacle 16 and a connector element receptacle 18.

For this purpose, the device 2 is equipped with a joining apparatus 20, which in turn has

- a housing body receptacle 16 for receiving the housing body 14,
- a connector element receptacle 18 for receiving an electrical connector element 6,
- a drive element for producing a joining movement between the housing body receptacle 16 and the connector element receptacle 18 so as to introduce the electrical connector element 6 at least in portions into a receiving chamber 12 of the housing body 14 in a joining direction F by means of the joining movement.

In this context, the joining apparatus 20 of the device 2 is set up and formed for jointly introducing, at least in some portions, a plurality of electrical connector elements 6 (uniformly denoted by reference numeral 6), received at the connector element receptacle 18, into the receiving chamber 12 of the housing body 14. It is thus possible to introduce a plurality of electrical connector elements 6 simultaneously into the housing body 14, this being associated with time and cost advantages.

Further, for the introduction, at least two electrical connector elements 6 of the plurality of connector elements 6 are arranged so as to be mutually offset in the joining direction F at the connector element receptacle 18. A connector element 6 can thus be arranged downstream in the joining direction F from a further connector element 6, in such a way that the first connector element 6 can also overlap the further connector element 6 at least in portions in the joining direction F.

In the device 2 shown, the connector elements 6 are arranged in a line-up of connector element pairs 24, one connector element 6 of each pair 24 being upstream from the further connector element 6' and therefore spaced apart therefrom in the joining direction F. For improved clarity, in FIG. 1, the connector element pairs 24 are representatively marked only once with reference numeral 24, four connector element pairs 24 being introduced into the housing body 14 in this embodiment of a plug-in connector.

The associated connector element pairs 24 are in turn lined up transversely to the joining direction F.

This pairwise arrangement may also be used for compositions in which two, three or more electrical connector elements 6, 6' form a pair. Thus, the two, three or more electrical connector elements 6, 6' of a connector element pair 24 are arranged at a spacing from one another in the joining direction F, the connector element pairs 24 being lined up at a spacing from one another, preferably a uniform spacing, transversely to the joining direction F.

Figure 3:
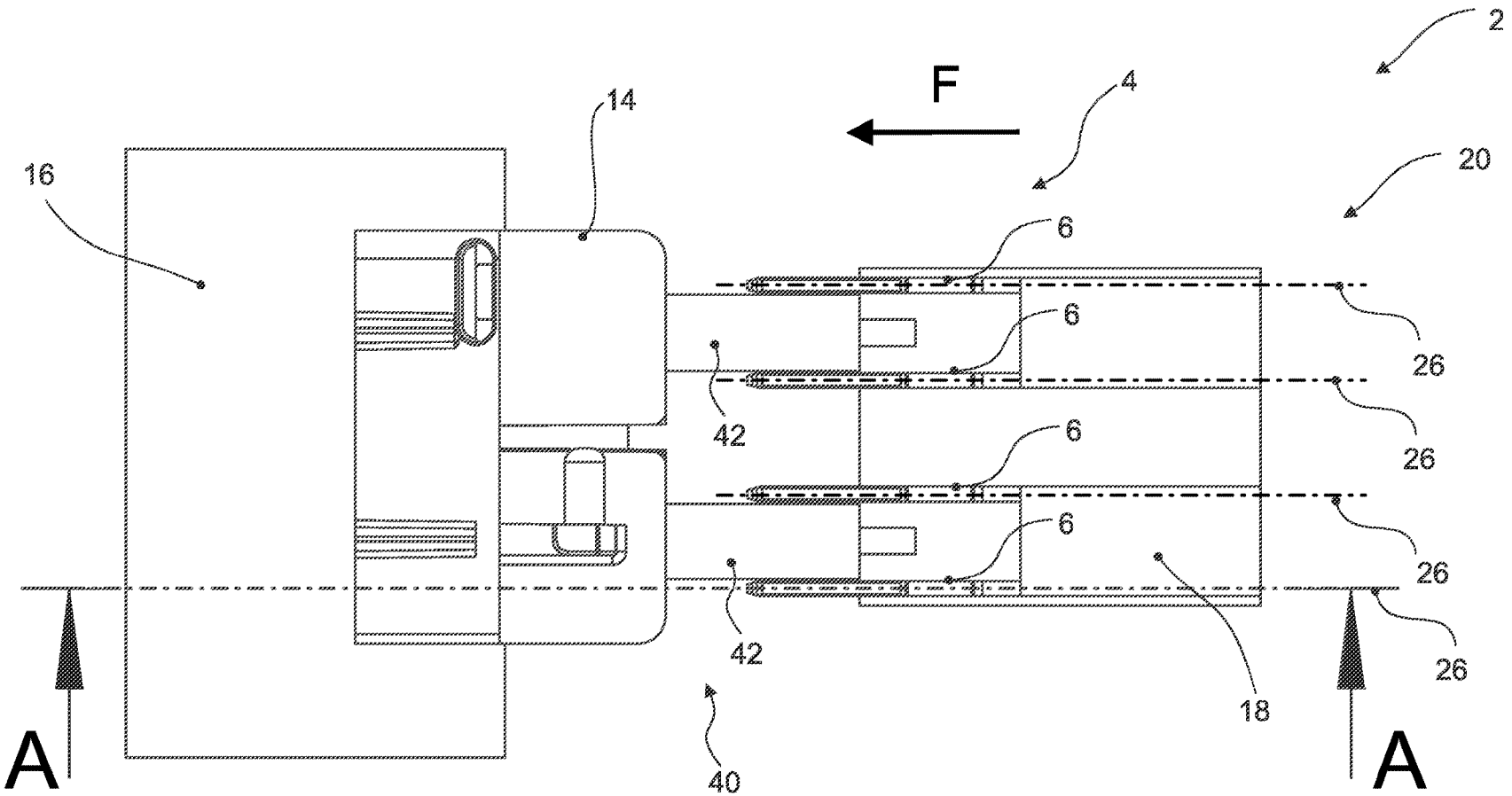
FIG. 3 is a schematic side view, marked as Y in FIG. 1, of the embodiment of a device according to the invention, in the same state as in FIG. 1.

For introduction into the receiving chamber 12 of the housing body 14, the electrical connector elements 6, 6' of each connector element pair 24 are arranged at the connector element receptacle 18 in a plane 26 jointly spanned by the first contacting portion 8 and second contacting portion 10 of one of the electrical connector elements 6, 6'. For improved clarity, in FIG. 1, only one plane 26 for one connector element pair 24 is shown as representative of the planes 26 for each of the connector element pairs 24, the planes 26 being arranged mutually in parallel transversely to the joining direction F. The relative arrangement of the planes 26 (uniformly denoted by reference numeral 26) is illustrated in FIG. 3.

Thus, the connector element receiver 16 is set up and formed for receiving a plurality of connector elements 6 in such a way that the first contacting portions 8 and/or the second contacting portions 10 of the plurality of electrical connector elements 6 are in each case arranged at a spacing from one another in a plurality of rows 28, 30 (in two rows 28, 30, illustrated by a chain-dotted line, in the configuration shown) as a grid, and in the manner of a matrix in the arrangement shown. In this context, the individual rows are directed transversely to the joining direction F, in such a way that the connector element pairs 24 are arranged at a spacing from one another transversely to the joining direction F, and mutually in parallel in the embodiment shown.

The device 2 is set up and formed for the plurality of electrical connector elements 6 to be introduced into the receiving chamber 12 of the housing body 14 by way of the joining movement via a lateral, slot-shaped opening 34 in the housing body 14. In this context, in the embodiment shown of a plug-in connector 4, one slot-shaped opening 34 is provided for each electrical connector element pair 24.

The electrical connector elements 6 used in the joining process shown are configured in such a way that the first contacting portion 8 and second contacting portion 10 of each element is formed as a contact pin.

To be able to introduce the connector elements 6 into the housing body 14 accordingly, the connector element receptacle 18 is set up and formed for receiving a plurality of electrical connector elements 6, which each have a first contacting portion 8 and second contacting portion 10 formed as a contact pin and each of their respective first/second contacting portions 8, 10 or contact pins are interconnected by means of a plate-shaped connecting portion 36. For improved clarity, the plate-shaped connecting portion 36 is representatively marked only once with reference numeral 36 by way of an electrical connector element 6 in Fig.

Figure 2:
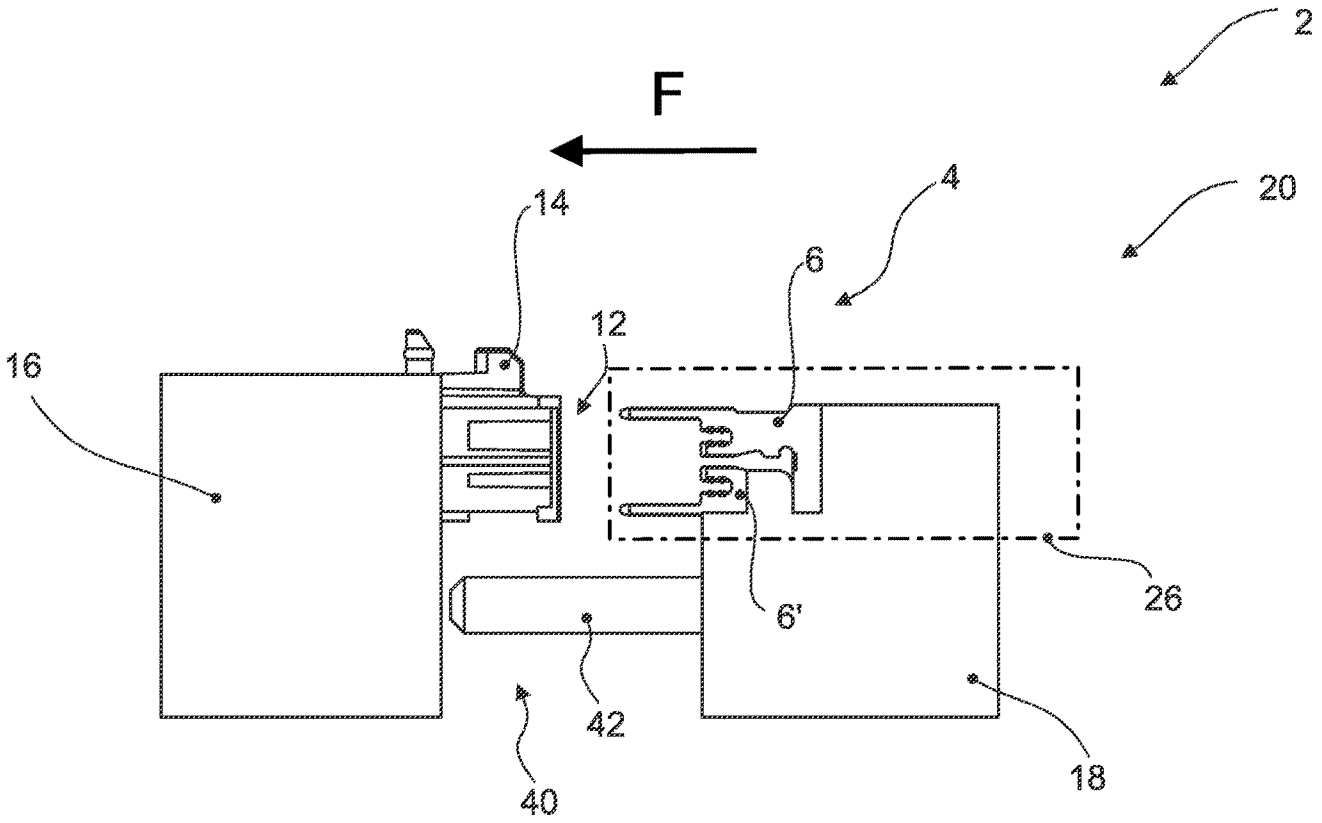
FIG. 2 is a schematic side view, marked as X in FIG. 1, of the embodiment of a device according to the invention from FIG. 1, in the same state as in FIG. 1.

FIG. 2 is a schematic side view, marked as X in FIG. 1, of the device 2, in the same state as in FIG. 1. FIG. 2 illustrates that the connector element receptacle 18 is set up and formed in such a way that the contacting portions 8, 10 of each electrical connector element 6 protrude in the joining direction F beyond an outer edge 38 of the connector element receptacle 18 at which the connector element 6 is arranged.

FIG. 3 is a schematic side view of the device 2, marked as Y in FIG. 1, in the same state as in FIG. 1. FIG. 3 illustrates that the plurality of electrical connector elements 6 is introduced into the housing body 14 by way of a translational (in this embodiment linear) movement between the housing body receptacle 16 and the connector element receptacle 18.

For this purpose, the drive element is set up and formed for producing a translational/linear joining movement between the housing body receptacle 16 and connector element receptacle 18.

To be able to guide the movement better, the joining apparatus 20 of the device 2 provides a guide device 40 for at least at times guiding the movement of the housing body receptacle 16 and the connector element receptacle 18 toward one another during the joining movement. The movement guidance relates in particular to the time interval in which the connector elements 6 are introduced into the housing body 14 and which is ended by achieving the joining state.

The movement sequence for introducing the electrical connector elements 6 into the housing body 14 is improved as a result.

In the device 2 shown, the guide device 20 has two first guide elements 42, each formed as a guide journal, and two corresponding second guide elements 44, each formed as a guide socket, which cooperate in relation to the aforementioned guide movement. First guide elements 42 and second guide elements 44 and the formation thereof as guide sockets 44 or guide journals 42 are uniformly provided with the same reference numeral.

Each guide journal 42 is arranged at the connector element receptacle 18, and the associated guide socket 44 is arranged at the housing body receptacle 16 and is formed in a simple manner by a cylindrical recess 44' in the housing body receptacle 16. The arrangement may also be provided differently, by, for example, a guide socket 44 being arranged at the connector element receptacle 18 and a guide journal 42 being arranged at the housing body receptacle 16. There are a plurality of arrangements for this purpose, and so the invention is not limited to those mentioned above.

It can be seen in FIG. 3 that the drive element produces a joining movement in parallel with a plug-in connector axis 46 (illustrated by a chain-dot line using a connector element) of the plug-in connector 4, along which axis there is a plug-in movement between the plug-in connector 4 and a contact carrier formed as a mating plug so as electrically to interconnect them.

The guide journal 42 and the guide socket 44 are configured so as to complement one another for the movement guidance. The guide journal 42 used in this embodiment of a device 2 according to the invention is cylindrical, and so the guide socket 44 is accordingly formed correspondingly cylindrical.

Figure 4:
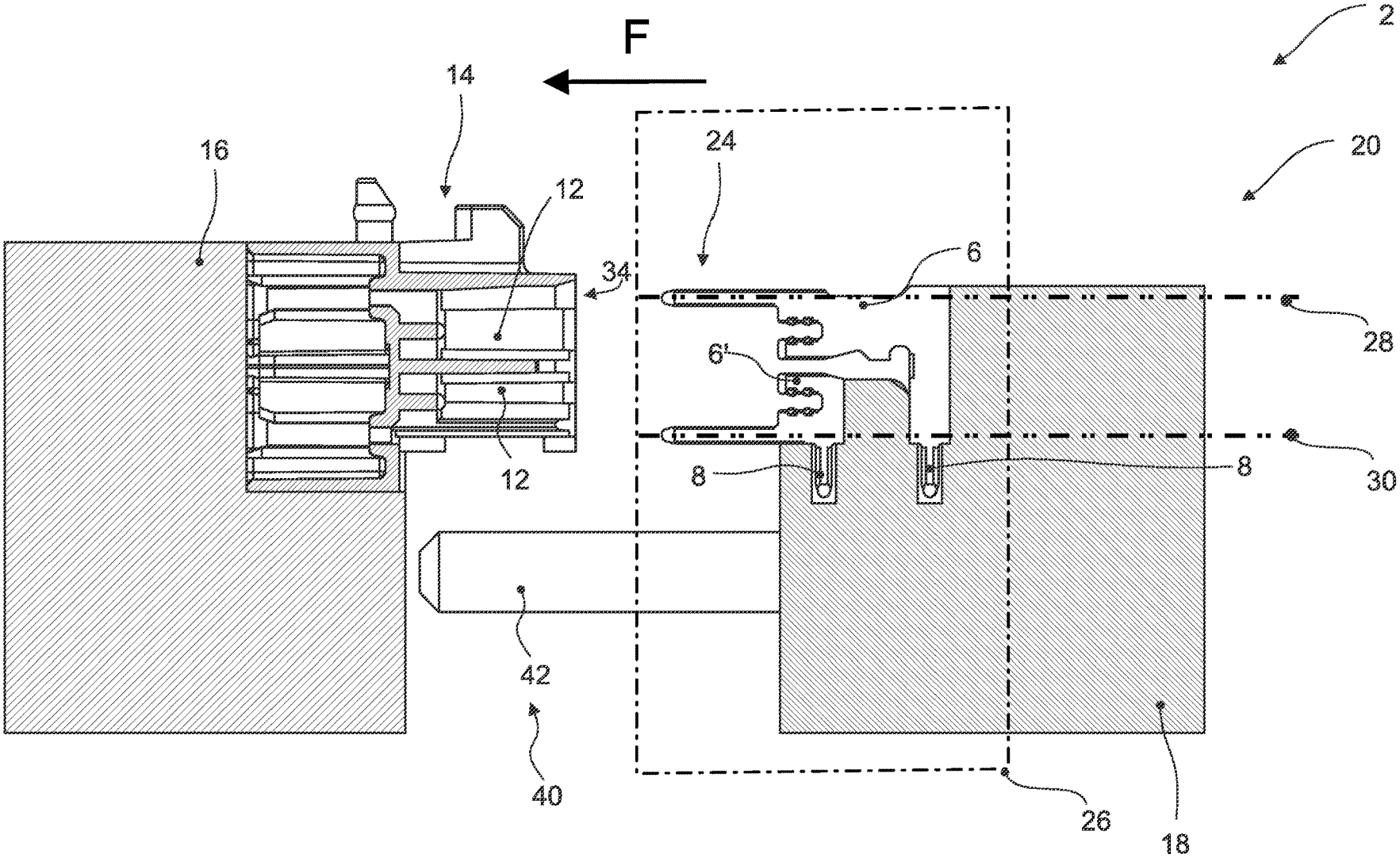
FIG. 4 is a schematic sectional view, marked as A-A in FIG. 3, of the embodiment of a device according to the invention, in the same state as in FIG. 3.

FIG. 4 is a schematic sectional drawing, marked as A-A in FIG. 3, of the device 2, in the same state as in FIG. 3.

Figure 5:
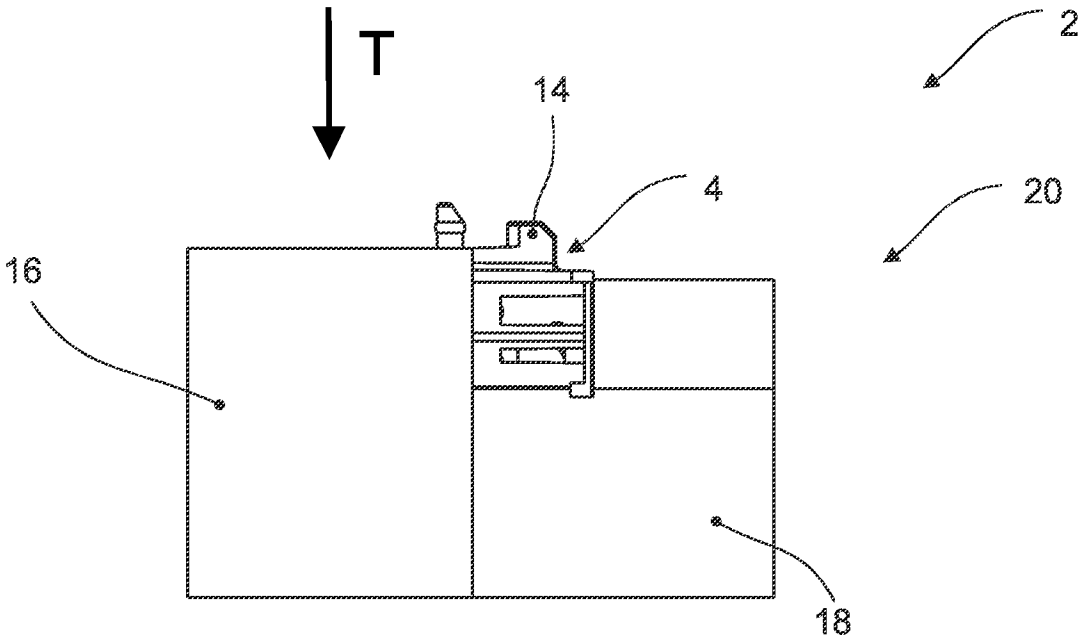
FIG. 5 shows the embodiment of a device according to the invention from FIG. 2, the connector element receptacle and the housing body receptacle being guided by a joining movement toward one another, and the electrical connector elements being introduced into the receiving chamber of the housing body when the plug-in connector is in the joining state.

FIG. 5 shows the device in the same perspective as in FIG. 2, the connector element receptacle and the housing body receptacle being guided toward one another by a joining movement, and the electrical connector elements being introduced into the receiving chamber of the housing body when the plug-in connector is in the joining state.

Figure 6:
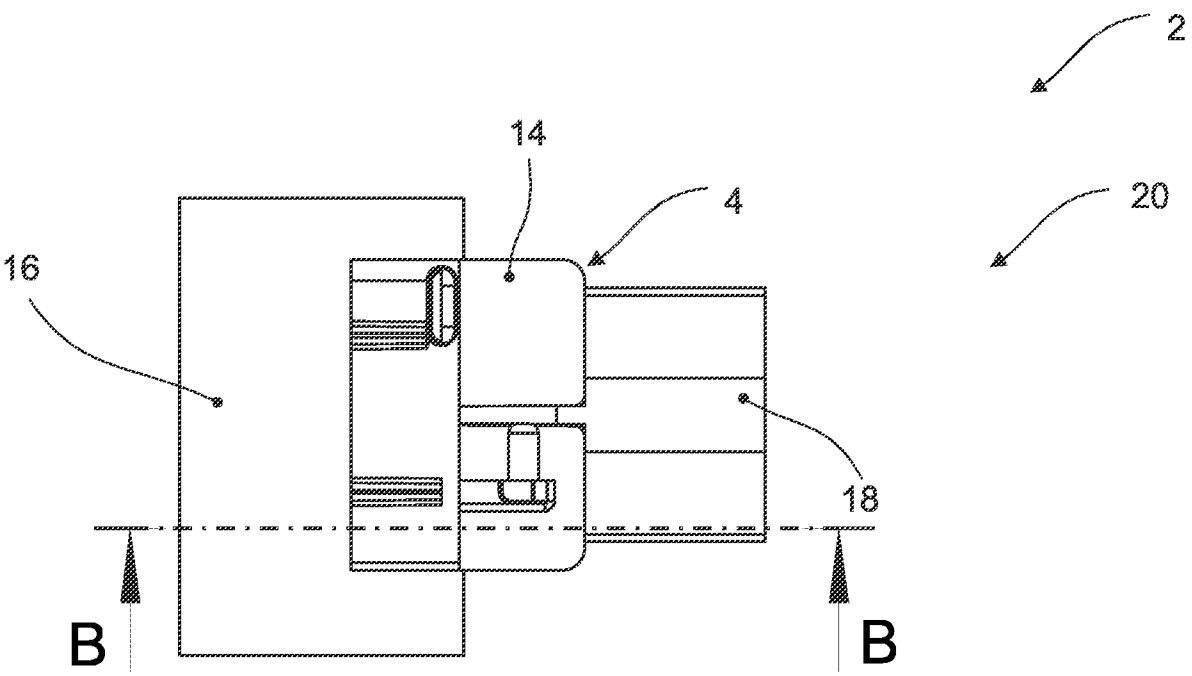
FIG. 6 is a schematic side view, marked as Tin FIG. 5, of the embodiment of a device according to the invention from FIG. 5, in the same state as in FIG. 5.

FIG. 6 is a schematic side view, marked as T in FIG. 5, of the device 2 from FIG. 5, in the same state as in FIG. 5.

Figure 7:
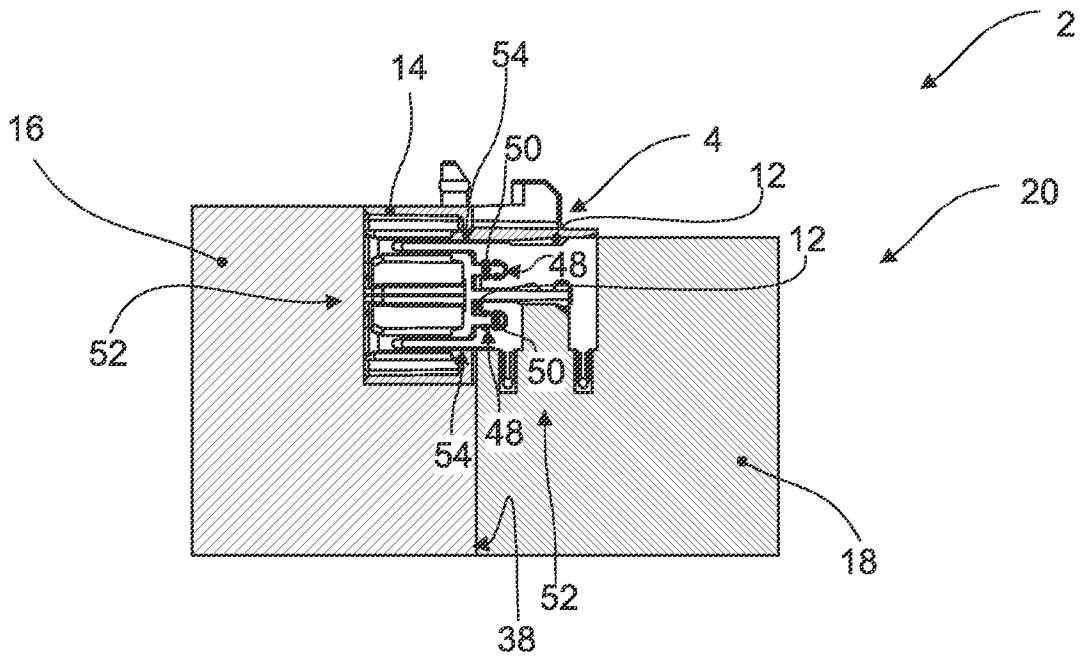
FIG. 7 is a schematic sectional view, marked as B-B in FIG. 6, of the embodiment of a device according to the invention from FIG. 6, in the same state as in FIG. 6.

FIG. 7 is a schematic sectional drawing, marked as B-B in FIG. 6, of the device from FIG. 6, in the same state as in FIG. 6.

FIG. 7 illustrates that the drive element produces a joining movement between the housing body receptacle 16 and the connector element receptacle 18 in such a way that in the joining state, in which each electrical connector element 6 is introduced at least in portions into the receiving chamber 12 of the housing body 14, a clamping slot 48 formed at the electrical connecting element 6 is at least in portions mounted in a clamping manner onto a housing rib 50 of the housing body 14 so as to hold the connector element 6 on the housing body 14.

Accordingly, the connector element receptacle 18 is also set up and formed for receiving a connecting element 6 which has a clamping slot 48 for the holding in the receiving chamber 12 of the housing body 14.

It can further be seen from FIG. 7 that during the joining movement the drive element moves the housing body receptacle 16 and the connector element receptacle 18 toward one another in such a way that in the joining state an associated contacting portion 8, 10 of at least one electrical connector element 6 exits the receiving chamber 12 of the housing body 14 through an associated exit opening 54 (uniformly denoted by reference numeral 54) at least one contacting face 52, preferably two contacting faces 52 (uniformly denoted by reference numeral 52), of the housing body 14.

In the device 2 shown, the associated contacting portions 8, 10 project out of an exit opening 54 provided therefor at both contacting faces 52 of the housing body 14.

Once the electrical connector elements 6, 6' have been introduced into the housing body, the plug-in connector 4 is finished and the device 2 can be removed.

Figure 8:
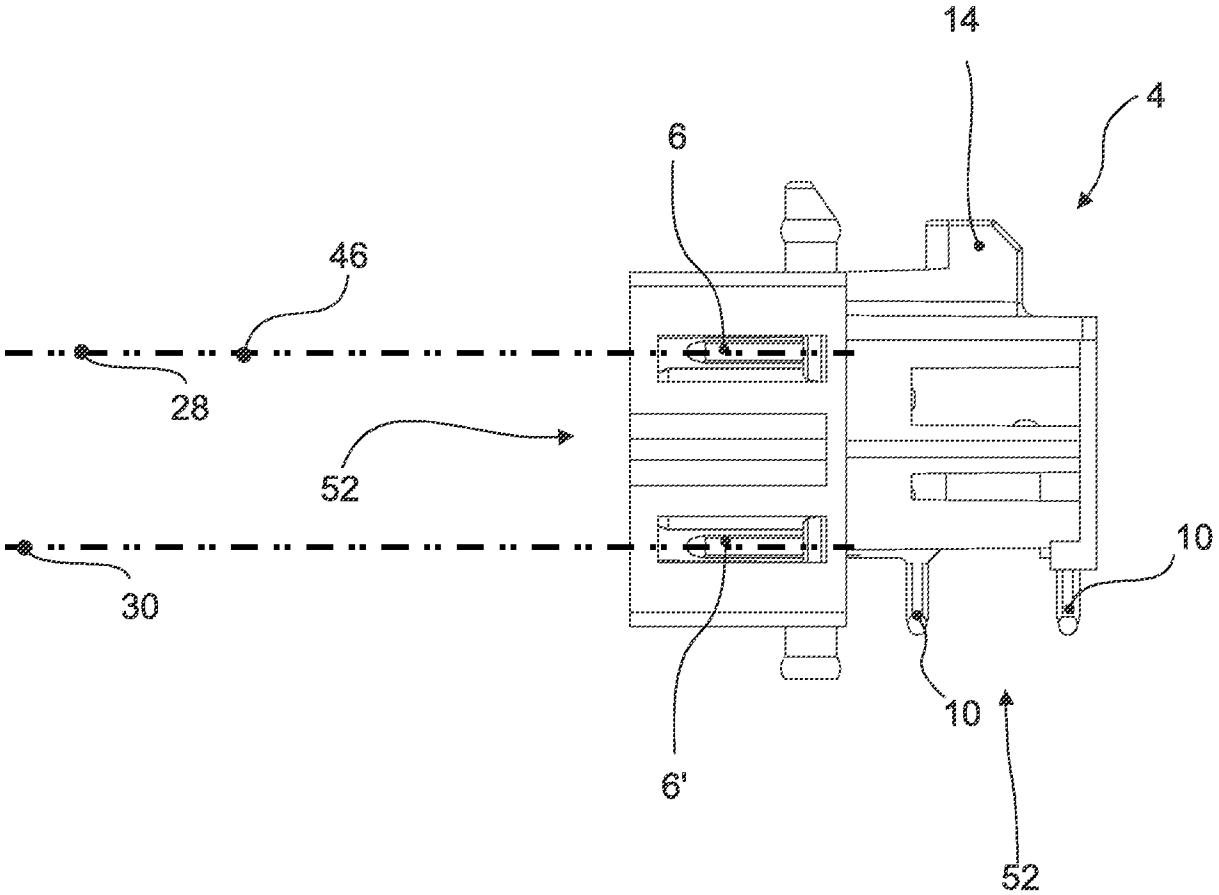
FIG. 8 is a schematic side view analogous to FIG. 7 of an example of a plug-in connector produced by a method according to the invention and by means of a device according to the invention.

FIG. 8 shows an electrical plug-in connector 4 which is manufactured by a method according to the invention or by means of a device according to the invention, but to which the invention is not limited.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

LIST OF REFERENCE NUMERALS

Joining direction F
Device 2
Plug-in connector 4
Electrical connector element 6, 6'
First contacting portion 8
Angled second contacting portion 10
Receiving chamber 12
Housing body 14
Housing body receptacle 16
Connector element receptacle 18
Joining apparatus 20
Connector element pairs 24
Plane 26
Rows 28, 30
Lateral, in particular slot-shaped, opening 34
Plate-shaped connecting portion 36
Outer edge 38
Guide means 40
First guide element/guide journal 42
Second guide element/guide socket 44
Cylindrical recess 44'
Plug-in connection axis 46
Clamping slot 48
Housing rib 50
Contacting face(s) 52
Exit opening 54

What is claimed:

1. A device for manufacturing an electrical plug-in connector, comprising:

a joining apparatus having a housing body receptacle configured to receive a housing body, and a connector element receptacle configured to receive an electrical connector element, which has a first contacting portion for plug-in connection to a contact of a first contact carrier and a second contacting portion, angled with respect thereto, for connection to a contact of a second contact carrier; and a drive element configured to produce a joining movement between the housing body receptacle and the connector element receptacle, so as to introduce the electrical connector element at least in portions into a receiving chamber of the housing body in a joining direction by way of the joining movement, wherein the joining apparatus is configured to jointly introduce a plurality of electrical connector elements, received at the connector element receptacle, at least in portions into the receiving chamber of the housing body, and wherein the connector element receptacle is configured such that at least two electrical connector elements of the plurality of connector elements are arrangeable so as to be mutually offset in the joining direction at the connector element receptacle.

2. The device according to claim 1, wherein the connector element receptacle is configured to introduce the at least two electrical connector elements in such a way that they are arrangeable at the connector element receptacle in a shared plane spanned by the first contacting portion and the second contacting portion of at least one of the at least two electrical connector elements.

3. The device according to claim 1, wherein the connector element receptacle is configured to receive a plurality of connector elements in such a way that the first contacting portions and/or the second contacting portions of the plurality of electrical connector elements (are in each case arranged at a spacing from one another in a plurality of rows as a grid.

4. The device according to claim 1, wherein the drive element is configured to move the housing body receptacle and the connector element receptacle toward one another during the joining movement in such a way that the joining movement introduces at least one electrical connector element of the plurality of electrical connector elements into the receiving chamber of the housing body via a lateral opening in the housing body.

5. The device according to claim 1, wherein the connector element receptacle is configured to receive a plurality of electrical connector elements, of which at least one electrical connector element has a first contacting portion and/or second contacting portion formed as a contact pin or contact socket.

6. The device according to claim 1, wherein the connector element receptacle is configured to receive at least one electrical connector element comprising a plate-shaped connecting portion, via which the first and second contacting portion of the elements are interconnected.

7. The device according to claim 1, wherein the connector element receptacle is configured such that at least one contacting portion of an electrical connector element protrudes in the joining direction beyond an outer edge of the connector element receptacle at which the connector element is arranged.

8. The device according to claim 1, wherein the drive element is configured to bring about a translational joining movement between the housing body receptacle and the connector element receptacle.

9. The device according to claim 1, wherein the joining apparatus comprises guide device configured to at least at times guiding the movement of the housing body receptacle and the connector element receptacle toward one another during the joining movement.

10. The device according to claim 1, wherein the joining apparatus has a guide device comprising at least a first guide element and a second guide element corresponding thereto, which cooperate so as to at least at times guide the movement of the housing body receptacle and the connector element receptacle toward one another during the joining movement.

11. The device according to claim 10, wherein the first guide element comprises a guide journal and the guide element corresponding thereto comprises a guide socket into which the guide journal dips at least in portions to guide the movement.

12. The device according to claim 1, wherein the drive element is configured to produce a joining movement in parallel with a plug-in connector axis of the plug-in connector, along which axis there is a plug-in movement between the plug-in connector and a contact carrier formed as a mating plug so as electrically to interconnect them.

13. The device according to claim 1, wherein the drive element is configured to produce a joining movement between the housing body receptacle and the connector element receptacle in such a way that in the joining state, in which each electrical connector element is introduced at least in portions into the receiving chamber of the housing body, a clamping slot formed at the electrical connecting element is at least in portions mounted in a clamping manner onto a housing rib of the housing body so as to hold the connector element on the housing body.

14. The device according to claim 1, wherein the connector element receptacle is configured in such a way that a first or second contacting portion of at least one electrical connector element protrudes beyond an outer edge of the connector element receptacle at which the connector element is arranged.

15. The device according to claim 1, wherein the drive element is configured to move the housing body receptacle and the connector element receptacle toward another during the joining movement in such a way that, in the joining state, at least one contacting portion of at least one electrical connector element exits the receiving chamber of the housing body through an associated exit opening at least one contacting face of the housing body.

16. The device according to claim 1, wherein the device is configured to carry out a method comprising the following steps:

a1) placing the housing body receptacle and the connector element receptacle in a receiving position for equipping them with the electrical connector element;

b1) arranging the electrical connector element at the connector element receptacle;

c1) arranging the housing body at the housing body receptacle;

d1) moving the housing body receptacle and the connector element receptacle toward one another using a drive element such that a joining movement is produced, by which the electrical connector element is introduced at least in portions into the receiving chamber of the housing body of the housing in a joining direction;

e1) spacing the housing body receptacle and the connector element receptacle apart from one another such that the housing body, along with the connector element introduced at least in portions into the receiving chamber, is removable from the device, wherein b2) a plurality of electrical connector elements are arranged at the connector element receptacle for joint introduction into the receiving chamber of a housing body, such that, for the introduction, at least two electrical connector elements of the plurality of connector elements are arranged so as to be mutually offset in the joining direction at the connector element receptacle, and c2) the plurality of electrical connector elements are jointly introduced at least in portions into the receiving chamber of the housing body by way of the joining movement between the housing body receptacle and the connector element receptacle.

17. A device for performing a method for manufacturing an electrical plug-in connector, an electrical connector element, which has a first contacting portion for plug-in connection to a contact of a first contact carrier and a second contacting portion, angled with respect thereto, for connection with a contact of a second contact carrier, being introduced into a receiving chamber of a housing body, vis-à-vis a device having a housing body receptacle and a connector element receptacle, the method comprising the following steps:

a1) placing the housing body receptacle and the connector element receptacle in a receiving position for equipping them with the electrical connector element;

b1) arranging the electrical connector element at the connector element receptacle;

c1) arranging the housing body at the housing body receptacle;

d1) moving the housing body receptacle and the connector element receptacle toward one another using a drive element such that a joining movement is produced, by which the electrical connector element is introduced at least in portions into the receiving chamber of the housing body of the housing in a joining direction;

e1) spacing the housing body receptacle and the connector element receptacle apart from one another such that the housing body, along with the connector element introduced at least in portions into the receiving chamber, is removable from the device, wherein b2) a plurality of electrical connector elements are arranged at the connector element receptacle for joint introduction into the receiving chamber of a housing body, such that, for the introduction, at least two electrical connector elements of the plurality of connector elements are arranged so as to be mutually offset in the joining direction at the connector element receptacle, and c2) the plurality of electrical connector elements are jointly introduced at least in portions into the receiving chamber of the housing body by way of the joining movement between the housing body receptacle and the connector element receptacle, the device comprising:

a joining apparatus having a housing body receptacle configured to receive a housing body, and a connector element receptacle configured to receive an electrical connector element, which has a first contacting portion for plug-in connection to a contact of a first contact carrier and a second contacting portion, angled with respect thereto, for connection to a contact of a second contact carrier; and a drive element configured to produce a joining movement between the housing body receptacle and the connector element receptacle, so as to introduce the electrical connector element at least in portions into a receiving chamber of the housing body in a joining direction by way of the joining movement, wherein the joining apparatus is configured to jointly introduce a plurality of electrical connector elements, received at the connector element receptacle, at least in portions into the receiving chamber of the housing body, and wherein the connector element receptacle is configured such that at least two electrical connector elements of the plurality of connector elements are arrangeable so as to be mutually offset in the joining direction at the connector element receptacle.

* * * * *